US005533617A

United States Patent [19]

Von Flatern

[11] Patent Number: 5,533,617

[45] Date of Patent: Jul. 9, 1996

[54] PAINT ROLLER SLEEVE STORAGE CONTAINER

[76] Inventor: Valerie R. Von Flatern, 56 Montgomery St., Springfield, Mass. 01151

[21] Appl. No.: 332,132

[22] Filed: Oct. 31, 1994

[51] Int. Cl.[6] ..... B65D 83/10

[52] U.S. Cl. ..... 206/361; 206/15.3; 206/446

[58] Field of Search ..... 206/15.2, 15.3, 206/361, 443, 446, 303

[56] References Cited

U.S. PATENT DOCUMENTS

| | | | |
|---|---|---|---|
| 3,294,225 | 12/1966 | Kenyon | 206/446 |
| 3,621,994 | 11/1971 | Brown | 206/446 |
| 4,467,533 | 8/1984 | Sica | 206/361 |
| 4,541,542 | 9/1985 | Florentino | 220/306 |
| 4,555,023 | 11/1985 | Sykes et al. | 206/446 |
| 4,700,830 | 10/1987 | O'Brien | 206/229 |
| 4,738,358 | 4/1988 | Kehl | 206/207 |
| 4,802,576 | 2/1989 | Kern | 206/225 |
| 4,880,114 | 11/1989 | Korte | 206/446 |
| 4,978,003 | 12/1990 | Foster | 206/361 |
| 5,178,274 | 1/1993 | Long | 206/361 |

*Primary Examiner*—David T. Fidei

*Attorney, Agent, or Firm*—David L. Baker; Rhodes & Ascolillo

[57] ABSTRACT

A storage container, for a paint roller sleeve, has a flexible resilient tubular housing for removably storing the sleeve therein. The tubular housing has a sealed end and an open end distal the sealed end. A chamber is located in the tubular housing to receive the sleeve. There is an inner wall, surrounding the chamber, in the tubular housing. A plurality of sleeve retaining bosses are attached to the inner wall at preselected points. At least one circumferential paint wiping ridge is formed on the inner wall. There is an outer wall on the tubular housing. At least one anti-rotational stacking member is attached to the outer wall. The anti-rotational stacking member has a rectangular circumferential outer surface. A sealing cap is removably attached to the open end of the tubular housing and there is an indicia surface on a top surface of the sealing cap. The sealing cap may be threadingly attached to or snapped onto the open end of the tubular housing.

4 Claims, 3 Drawing Sheets

PAINT ROLLER SLEEVE STORAGE CONTAINER

BACKGROUND OF THE INVENTION

1. Field of the Invention

This invention relates to a paint roller sleeve storage container, in general and, in particular, to a paint roller sleeve storage container enabling the user to stack the containers for storage in multi-sleeve jobs and for display during sale. The storage container also is designed to easily remove the sleeve from a roller frame.

2. Description of the Related Art

Painting the walls and ceilings of a house or other structure presents many problems. One of those problems is how to conveniently and temporarily store your paint roller sleeves overnight or during breaks or during changes of sleeves for color changes without going to the time consuming job of thoroughly cleaning the sleeves or the costly solution of just throwing the sleeves away when the paint on the sleeve dries. Another problem, especially for wholesalers and retailers of painting equipment and for painters that have a large inventory of roller sleeves, is how to conveniently store and display paint roller sleeves. The sleeves are round and generally resist stacking in an orderly manner. In the past, several efforts have been made to solve these problems.

U.S. Pat. No. 4,541,542 to G. Florentino on Sep. 17, 1985 for a Paint Tray Cover shows a paint roller tray with a resealable cover to store a roller frame, handle and sleeve for short intervals between painting sessions.

U.S. Pat. No. 4,700,830 to L. B. O'Brien on Oct. 20, 1987 for a Paint Roller and Hose Caddy describes a container for placement and temporary storage of a powered paint roller and hose assembly.

U.S. Pat. No. 4,738,358 to C. W. Kehl on Apr. 19, 1988 for a Paint Roller Storage Container and Extractor describes a paint roller sleeve storage container having radially inward pointing projections for engaging a sleeve to allow the user to squeeze the container and pull the roller frame from the sleeve.

U.S. Pat. No. 4,802,576 to I. Kern on Feb. 7, 1989 for a Storage Container for a Paint Roller shows a container for storing a paint roller including frame and handle. The container is sealed by using a foil seal. Additional foil is supplied on a roll integral with the container.

U.S. Pat. No. 5,178,274 to N. E. Long on Jan. 12, 1992 for a Holder Container for a Paint Roller shows a paint roller holder that retains a paint roller frame and a sleeve during short interruptions.

The disclosures discussed above have not addressed all the problems solved by the present invention. The present invention provides a sealable container that could be manufactured with either a threaded cap or a snap-on cap. The present invention also allows the user to pull the roller sleeve off of the roller frame without having to grasp a roller sleeve wet with paint. This invention allows the user to wipe the excess paint off of the roller sleeve as the sleeve is removed from the container thereby reducing the chance of paint spillage. The present invention further solves the problem, encountered by painters and merchants, of storing a number of sleeves efficiently by providing a container that not only preserves the integrity of the paint on the sleeve and the sleeve itself but provides a container that will stack conveniently without rolling all over the area.

SUMMARY OF THE INVENTION

The present invention discloses a paint roller sleeve container that may be packaged with a sleeve therein or can be purchased by a user along with or after the sleeve is purchased. The container has stacking rings spaced at intervals around the tubular housing that stores the sleeve. The stacking rings have flat surfaces that allow the paint roller sleeve containers to be stacked easily for storage or display. A novel feature of the present invention is the wiping ring placed on the inner wall of the chamber in the container. The wiping ring can be used to wipe excess paint from the sleeve as the sleeve is removed form the container. Also provided is a number of retaining bosses that contact the sleeve when the user squeezes the tubular housing. The bosses grip the sleeve and assist the user in pulling the sleeve from the roller frame. The container is also made of plastic and therefore is easily cleaned.

In one aspect of the present invention, a storage container, for a paint roller sleeve, includes a flexible resilient tubular housing for removably storing the sleeve therein. The tubular housing has a sealed end and an open end distal the sealed end.

There is a chamber in the tubular housing to receive the sleeve. An inner wall on the tubular housing surrounds the chamber. There is a plurality of sleeve retaining bosses on the inner wall and at least one circumferential paint wiping ridge on the inner wall. There is an outer wall on the tubular housing. A sealing cap is removably attached to the open end of the tubular housing.

In another aspect of the present invention, a storage container, for a paint roller sleeve, has a flexible resilient tubular housing for removably storing the sleeve therein. The tubular housing includes a sealed end and an open end distal the sealed end. There is a chamber in the tubular housing to receive the sleeve. There is an inner wall on the tubular housing that defines the inner chamber. There is a plurality of sleeve retaining bosses on the inner wall. At least one circumferential paint wiping ridge is attached to or formed on the inner wall. There is an outer wall on the tubular housing to which at least one anti-rotational stacking member is attached. A sealing cap is removably attached to the open end of the tubular housing.

It is an object of this invention to provide a paint roller sleeve container that will allow a user to store a roller sleeve saturated with wet paint for intervals between painting sessions and be able to use the sleeve again without cleaning and reconditioning the sleeve.

It is another object of this invention to provide a paint roller sleeve container that will allow a user to stop painting for an extended period of time without having to dispose of the sleeve just used and purchase another to start painting again.

DESCRIPTION OF THE PREFERRED EMBODIMENTS

Figures 1, 2:
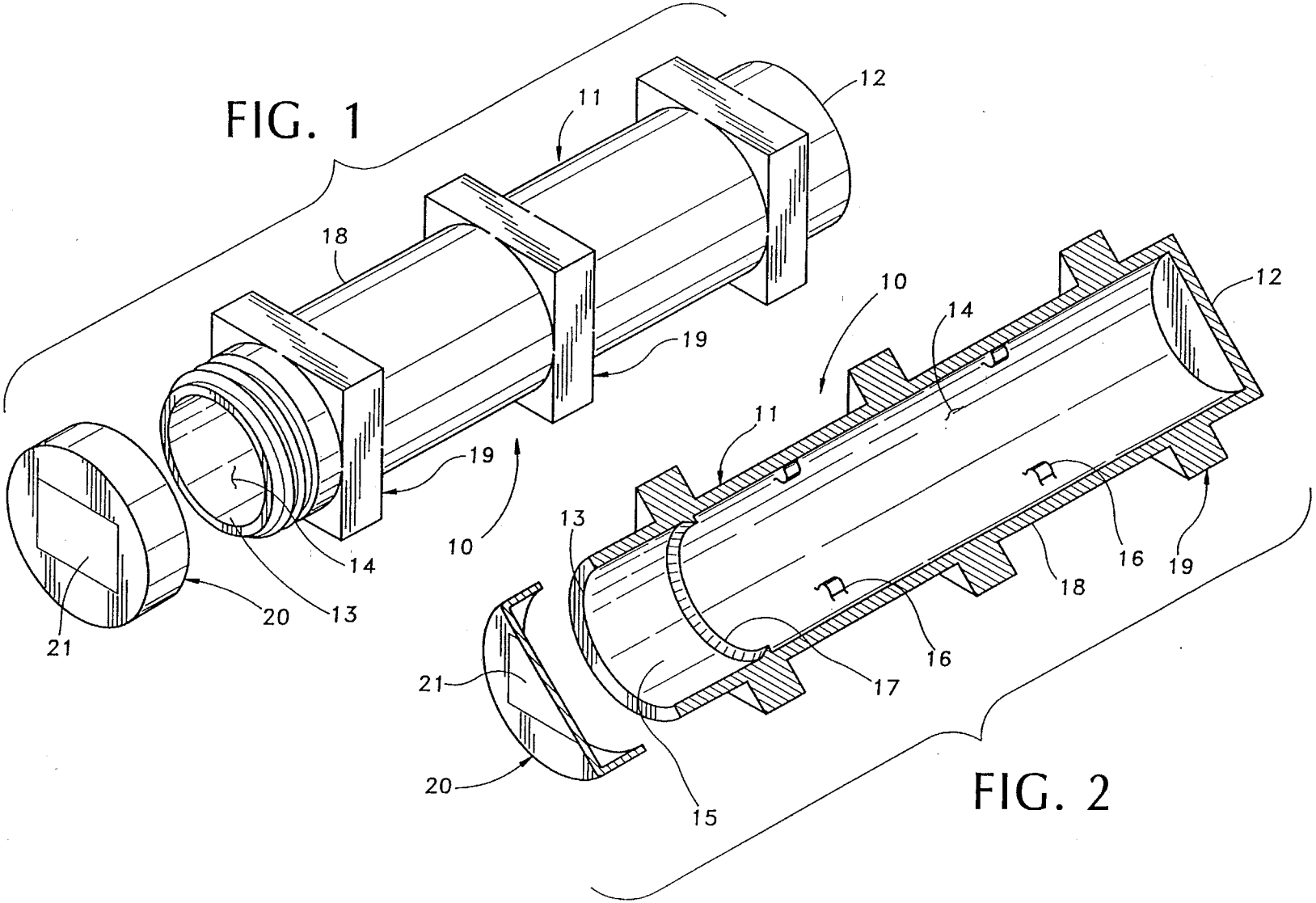
FIG. 1 is an exploded perspective view of a Paint Roller Sleeve Storage Container showing a threaded sealing cap.
FIG. 2 is an exploded cross-sectional perspective view of a Paint Roller Sleeve Storage Container showing a snap-on sealing cap.
Figure 6:
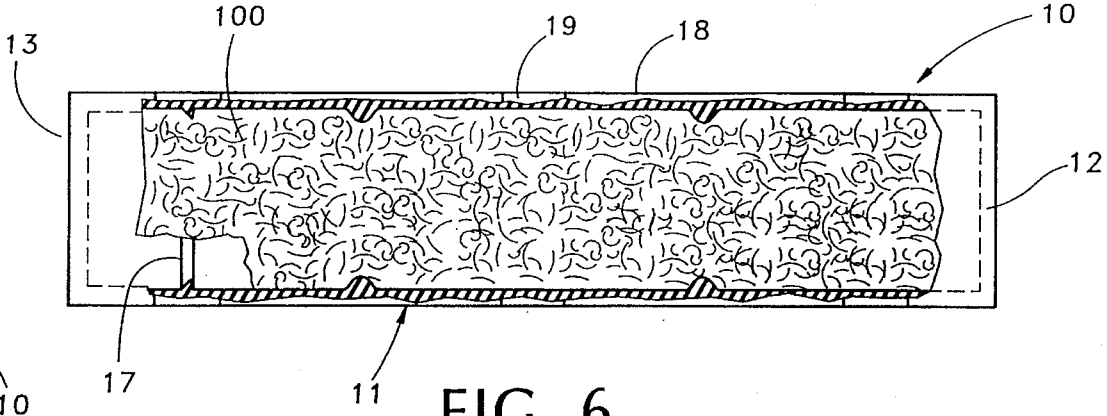
FIG. 6 is a cut-away view of the container showing a partial cut-away view of the roller sleeve therein to show the relationship of the retaining bosses and the wiping ridge, on the inner wall of the chamber of the container, to the roller sleeve.
Figure 7:
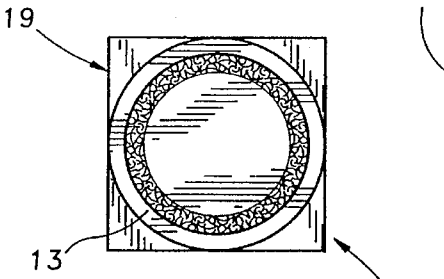
FIG. 7 is a right side elevational view of FIG. 6 showing the roller sleeve in place.
Figure 5:
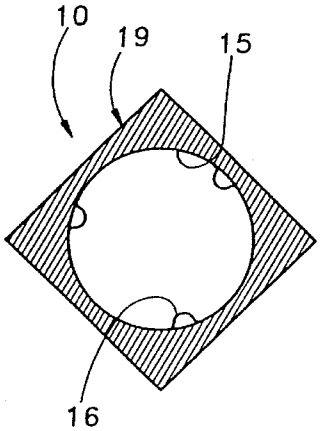
FIG. 5 is a cross-sectional view along line 5—5 of FIG. 3.
Figure 3:
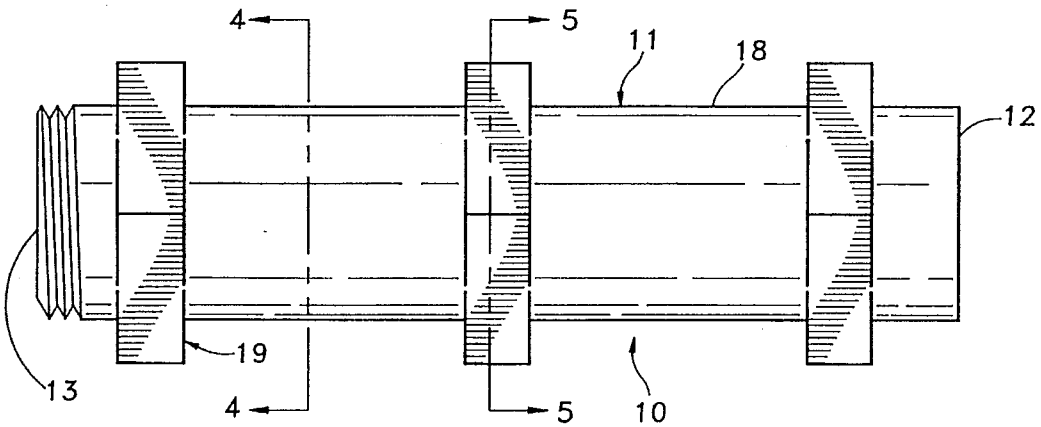
FIG. 3 is a tilted side elevational view of the threaded container without a cap thereon.
Figure 4:
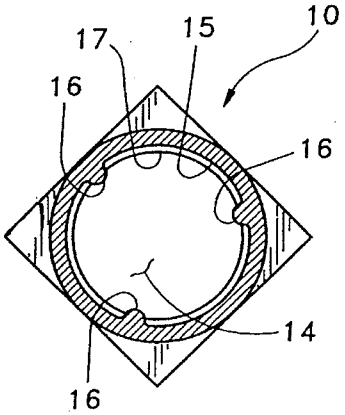
FIG. 4 is a cross-sectional view along line 4—4 of FIG. 3.
Figure 8:
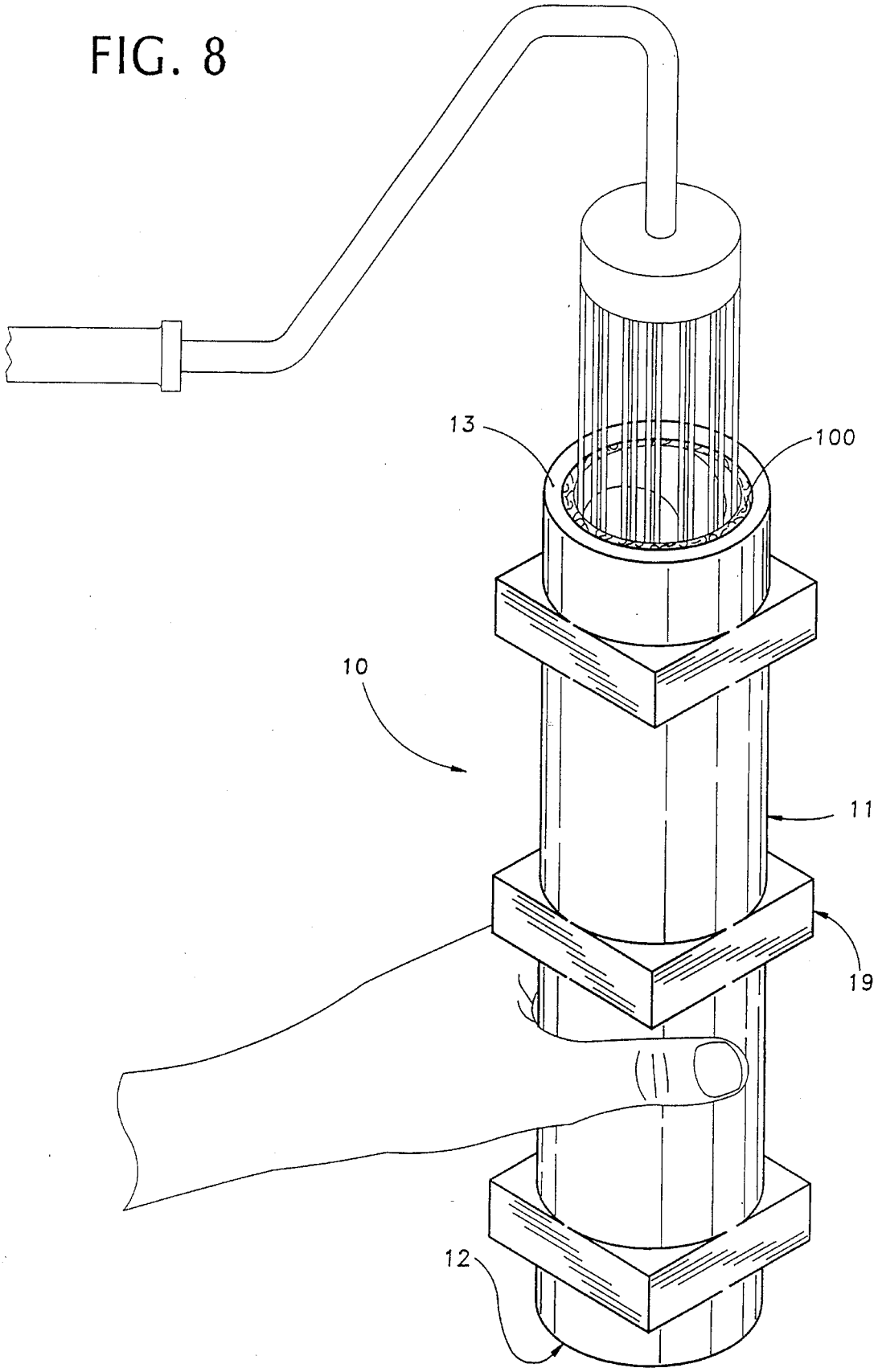
FIG. 8 is an exploded perspective of a Paint Roller Sleeve Storage Container showing a paint roller sleeve about to be removed.

Referring to FIGS. 1 through 8, a storage container 10, for a paint roller sleeve 100, has a flexible resilient tubular housing 11 for removably storing the sleeve 100 therein. The tubular housing 11 has a sealed end 12 on one end of the tubular housing 11 and an open end 13 on another end of the tubular housing distal the sealed end 12. There is a chamber 14 in the tubular housing to receive the sleeve 100. There is an inner wall 15 on the tubular housing. A plurality of sleeve retaining bosses 16 are integrally attached to the inner wall 15 at preselected points. There is at least one circumferential paint wiping ridge 17 integrally formed on the inner wall 15. The paint roller sleeve storage container 10 is flexible and resilient. When squeezed, it returns to its formed shape. The entire container 10 is preferably formed of plastic and will likely be molded by known methods such as injection molding. The plastic used will, upon being molded in its final form, will be flexible, resilient and have a memory that will allow it to return to its molded form when squeezed into another shape temporarily.

There is an outer wall 18 on the tubular housing 11. At least one (preferably three) anti-rotational stacking member 19 is attached to the outer wall. The stacking members 19 and the tubular housing may be molded together or the stacking members may be slidingly and removably placed or press-fitted onto the tubular housing 11 or slidingly placed thereon and adhered thereto. The anti-rotational stacking members 19 preferably have a rectangular circumferential outer surface but could have six or eight sides and still stack well.

A sealing cap 20 is removably attached to the open end 13 of the tubular housing. There is an indicia surface 21 on a top surface of the sealing cap 20. The indicia surface 21 may be used to record the paint color and type along with the job and date on which the paint was used. The sealing cap 20 may be threadingly attached (See FIGS. 1 and 4) to or snapped onto the open end (see FIGS. 2, 6 and 8) of the tubular housing.

In operation, a sleeve 100, still on the roller frame (not shown), is inserted into the chamber 14 of the tubular housing 11. Once the sleeve is fully in the chamber, the user grasps the tubular housing, squeezes the housing and causes the sleeve retaining bosses 16 to be inserted into the nap of the sleeve. This releasingly secures the sleeve 100 in the chamber 14 of the housing and creates enough resistance to the removal of the sleeve from the chamber that the roller frame can be removed from the sleeve (see FIG. 8). The cap 20 can then be placed over the open end 13 of the housing thereby sealing the sleeve 100 in the chamber. When the sleeve is to be used again or if the user decides to clean the sleeve for longer storage, the cap 20 is removed by unscrewing or snapping off depending on which type of cap was provided. The roller frame is inserted into the sleeve 100 and the sleeve is withdrawn from the chamber 14. The wiping ridge 17 on the inner wall 15 surrounding the chamber 14 wipes any paint excess from the sleeve as the sleeve is removed. This is feature greatly appreciated by anyone who has had to cope with excess paint dripping off of a roller sleeve before you can get it to a tray or against a wall to be painted. The container 10 can be resealed by placing the cap 20 back onto the open end of the container. The container 10 can then be used to store the sleeve 100 again or the container may be easily cleaned for the next sleeve.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A storage container, for a paint roller sleeve, comprising:

(a) a flexible resilient tubular housing for removably storing the sleeve therein;

(b) the tubular housing comprising:
a sealed end on the tubular housing;
an open end distal the sealed end;
a chamber in the tubular housing to receive the sleeve;
an inner wall on the tubular housing;
a plurality of sleeve retaining bosses on the inner wall;
at least one circumferential paint wiping ridge on the inner wall; and
an outer wall on the tubular housing;

(c) at least one anti-rotational stacking member attached to the outer wall; and (d) a sealing cap removably attached to the open end of the tubular housing.

2. A storage container, for a paint roller sleeve, comprising:

(a) a flexible resilient tubular housing for removably storing the sleeve therein;

(b) the tubular housing comprising:
a sealed end on the tubular housing;
an open end distal the sealed end;
a chamber in the tubular housing to receive the sleeve;
an inner wall on the tubular housing;
a plurality of sleeve retaining bosses on the inner wall;
at least one circumferential paint wiping ridge on the inner wall; and
an outer wall on the tubular housing;

(c) at least one anti-rotational stacking member attached to the outer wall;

(d) a sealing cap removably attached to the open end of the tubular housing; and (e) an indicia surface on a top surface of the sealing cap.

3. A storage container, for a paint roller sleeve, as described in claim 2 wherein the sealing cap further comprises being threadingly attached to the open end of the tubular housing.

4. A storage container, for a paint roller sleeve, as described in claim 2 wherein the at least one anti-rotational stacking member further comprises a rectangular circumferential outer surface.

* * * * *